US005479713A

United States Patent [19]

Wood

[11] Patent Number: 5,479,713

[45] Date of Patent: Jan. 2, 1996

[54] LINE BLOCK MASONRY ALIGNMENT SYSTEM FOR USE IN CONJUNCTION WITH DOOR BUCKS AND A PLUMB LINE

[76] Inventor: Robert W. Wood, P.O. Box 48, Main St., Fayette, N.Y. 13065

[21] Appl. No.: 345,604

[22] Filed: Nov. 28, 1994

[51] Int. Cl.[6] ..... G01C 15/10

[52] U.S. Cl. ..... 33/407; 33/409; 33/518

[58] Field of Search ..... 33/404, 406, 407, 33/408, 409, 518

[56] References Cited

U.S. PATENT DOCUMENTS

| | | | |
|---|---|---|---|
| 2,834,112 | 5/1958 | Seagraves | 33/409 |
| 3,200,500 | 8/1965 | Stone | 33/409 |
| 3,205,582 | 9/1965 | Andrews | 33/407 |
| 3,408,742 | 11/1968 | Caprio et al. | 33/409 |
| 3,555,688 | 1/1971 | Smathers | 33/408 |

*Primary Examiner*—Alvin Wirthlin

[57] ABSTRACT

A line block masonry alignment system comprising at least two rigid and generally U-shaped line blocks, each line block having a short leg, a long leg, and a cross-leg therebetween and with the line block defining a holding space for receipt of a door buck, each leg having a generally rectangular cross-section, the cross leg having a length equal to that of the long leg, the cross leg further having a longitudinal groove formed along its peripheral extent at a location remote from the holding space and with the groove projected through both the long leg and short leg, the short leg having an axial bore formed therethrough with the bore in communication with the groove and with the groove and bore of each line block adapted to hold and retain an end of a plumb line therein for facilitating the construction of a level course of masonry.

5 Claims, 4 Drawing Sheets

LINE BLOCK MASONRY ALIGNMENT SYSTEM FOR USE IN CONJUNCTION WITH DOOR BUCKS AND A PLUMB LINE

BACKGROUND OF THE INVENTION

1. Field of the Invention

The present invention relates to a line block masonry alignment system for use in conjunction with door bucks and a plumb line and more particularly pertains to allowing a user to level, align, and plumb a course of masonry with a line block masonry alignment system.

2. Description of the Prior Art

The use of masonry alignment mechanisms is known in the prior art. More specifically, masonry alignment mechanisms heretofore devised and utilized for the purpose of allowing a user to construct a course of masonry are known to consist basically of familiar, expected and obvious structural configurations, notwithstanding the myriad of designs encompassed by the crowded prior art which have been developed for the fulfillment of countless objectives and requirements.

By way of example, U.S. Pat. No. Des. 300,599 to Ledenican discloses a masonry guide line holder. U.S. Pat. No. Des. 332,381 to Rotellini, Jr. discloses a masonry line holder. U.S. Pat. No. 3,440,728 to Hackworth discloses a holder for mason's line. U.S. Pat. No. 3,555,688 to Smathers discloses a mason's guide line holder. U.S. Pat. No. 3,751,810 to Valva discloses a mason's line holder.

While these devices fulfill their respective, particular objective and requirements, the aforementioned patents do not describe a line block masonry alignment system for use in conjunction with door bucks and a plumb line that is simple in design and allows a user to readily level, align, and plumb a course of masonry.

In this respect, the line block masonry alignment system for use in conjunction with door bucks and a plumb line according to the present invention substantially departs from the conventional concepts and designs of the prior art, and in doing so provides an apparatus primarily developed for the purpose of allowing a user to level, align, and plumb a course of masonry.

Therefore, it can be appreciated that there exists a continuing need for new and improved line block masonry alignment system for use in conjunction with door bucks and a plumb line which can be used for allowing a user to level, align, and plumb a course of masonry. In this regard, the present invention substantially fulfills this need.

SUMMARY OF THE INVENTION

In the view of the disadvantages inherent in the known types of masonry alignment mechanisms now present in the prior art, the present invention provides an improved line block masonry alignment system for use in conjunction with door bucks and a plumb line.

To attain this, the present invention essentially comprises, in combination, at least two rigid plastic and generally U-shaped line blocks. Each line block has squared-off corners. Each line block is formed of a short leg, a long leg, and a cross-leg therebetween. Each line block defines a holding space for receiving a door buck. Each leg has a central axis and a generally rectangular cross-section. The long leg has a length of at least 60% greater than that of the short leg. The cross leg has a length equal to that of the long leg. The cross leg further includes a longitudinal groove formed along its peripheral central extent at a location remote from the holding space. The groove is projected through both the long leg and short leg. The short leg has an axial circular bore formed therethrough with the bore in communication with the groove and with the diameter of the bore being equal to the depth of the groove. The groove and bore of each line block are adapted to hold and retain an end of a line therein. Lastly, a line is included and has a knot formed at each end. The line is disposed within the groove of each line block with each knot thereof positioned within a separate bore of each line block. The line is extendable in a taut configuration to thereby define a plumb line for facilitating the level construction of a course of masonry when the line blocks are secured between a pair of spaced door bucks.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is another object of the present invention to provide a new and improved line block masonry alignment system for use in conjunction with door bucks and a plumb line which may be easily and efficiently manufactured and marketed.

It is a further object of the present invention to provide a new and improved line block masonry alignment system for use in conjunction with door bucks and a plumb line which is of durable and reliable construction.

An even further object of the present invention is to provide a new and improved line block masonry alignment system for use in conjunction with door bucks and a plumb line which is susceptible of a low cost of manufacture with regard to both materials and labor, and which accordingly is then susceptible of low prices of sale to the consuming public, thereby making such a line block masonry alignment system for use in conjunction with door bucks and a plumb line economically available to the buying public.

Even still another object of the present invention is to provide a new and improved line block masonry alignment system for use in conjunction with door bucks and a plumb line for allowing a user to level, align, and plumb a course of masonry.

Lastly, it is an object of the present invention to provide a new and improved line block masonry alignment system for use in conjunction with door bucks and a plumb line comprising at least two rigid and generally U-shaped line blocks, each line block having a short leg, a long leg, and a cross-leg therebetween and with the line block defining a holding space for receipt of a door buck, each leg having a generally rectangular cross-section, the cross leg having a length equal to that of the long leg, the cross leg further having a longitudinal groove formed along its peripheral extent at a location remote from the holding space and with the groove projected through both the long leg and short leg, the short leg having an axial bore formed therethrough with the bore in communication with the groove and with the groove and bore of each line block adapted to hold and retain an end of a line therein for facilitating the level construction of a course of masonry when the line is extended taut.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
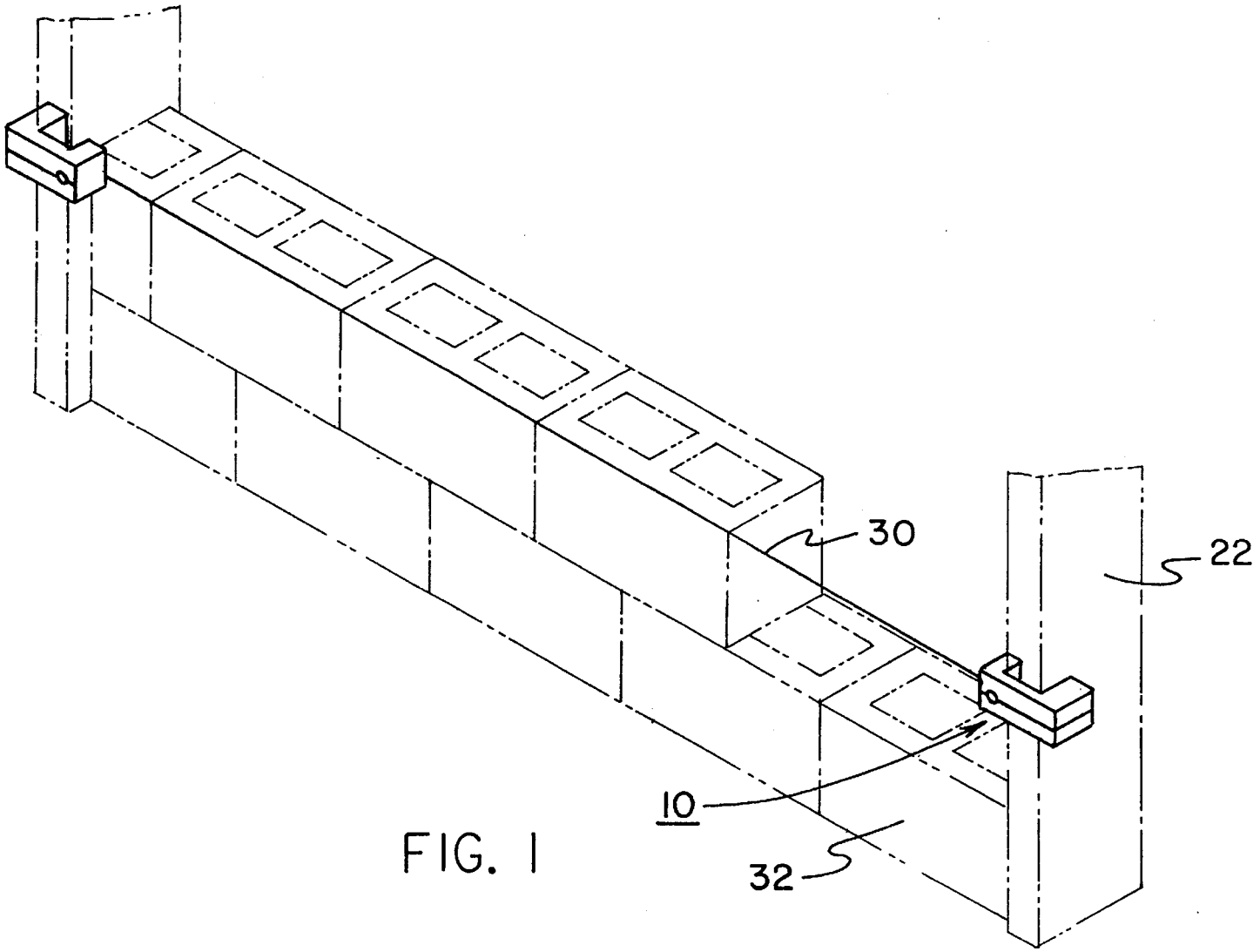
FIG. 1 is a perspective view of the preferred embodiment constructed in accordance with the principles of the present invention in operation with a pair of door bucks for aligning a course of masonry.
Figure 2:
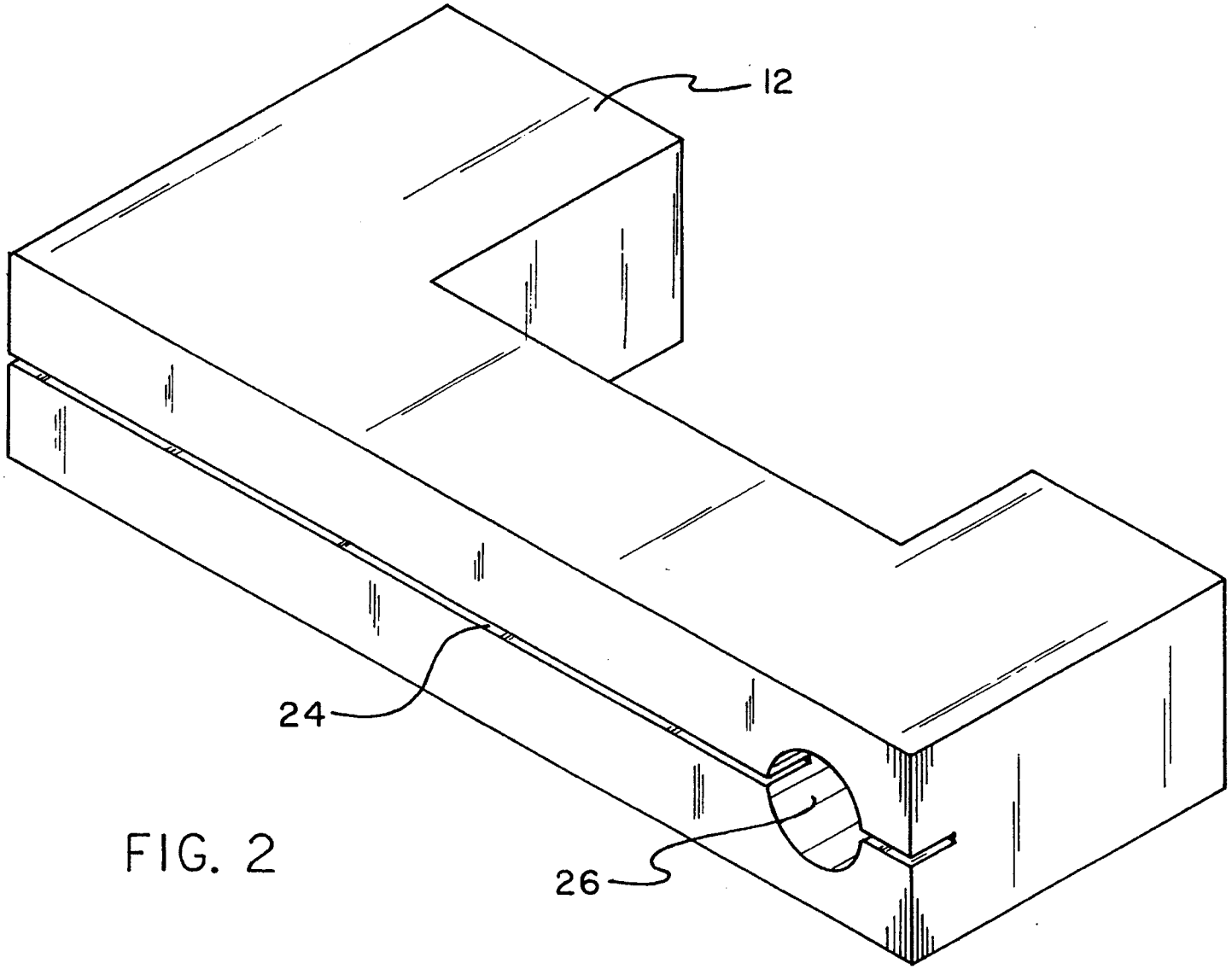
FIG. 2 is a perspective view of the preferred embodiment constructed in accordance with the principles of the present invention.
Figure 3:
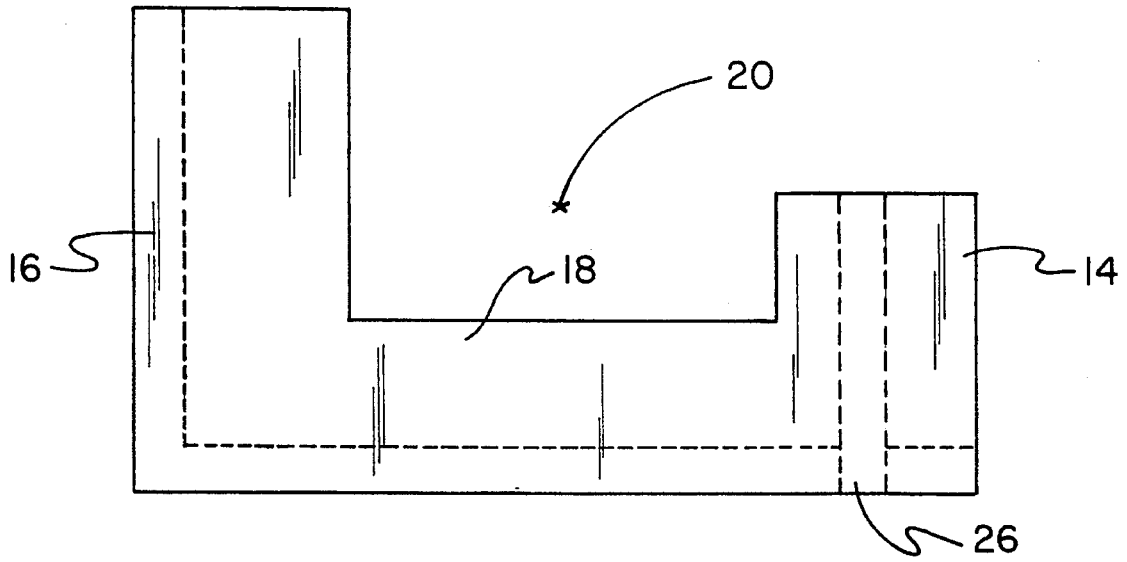
FIG. 3 is a plan view of the present invention as shown in FIG. 2.
Figure 4:
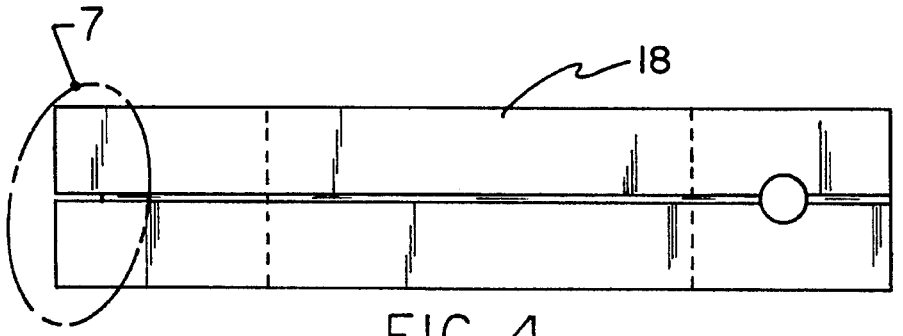
FIG. 4 is a side-elevational view of the preferred embodiment of the present invention.
Figure 5:
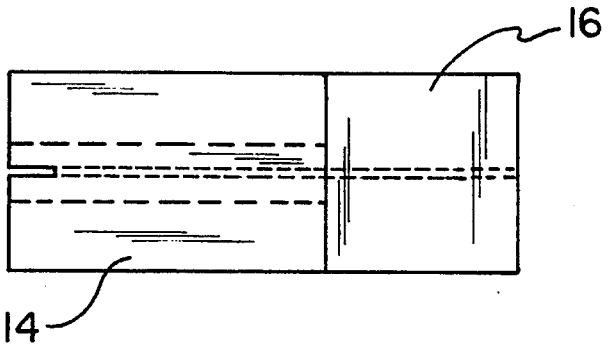
FIG. 5 is yet another side-elevational view of the present invention.
Figure 6:
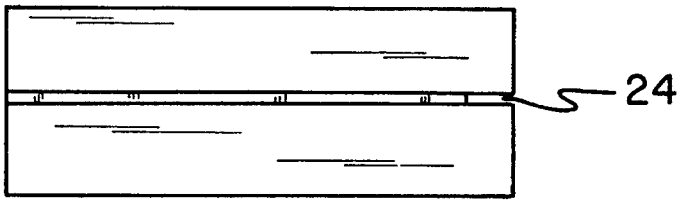
FIG. 6 is yet another side-elevational view of the present invention.
Figure 7:
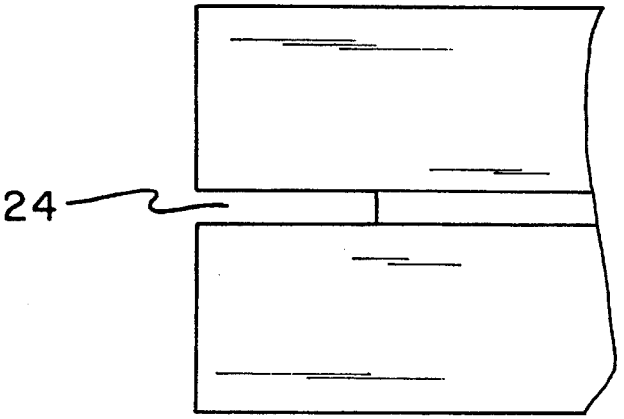
FIG. 7 is an enlarged view of the groove on the present invention as shown in FIG. 4.

With reference now to the drawings, and in particular, to FIG. 1 thereof, the preferred embodiment of the new and improved line block masonry alignment system for use in conjunction with door bucks and a plumb line embodying the principles and concepts of the present invention and generally designated by the reference number 10 will be described.

The present invention is comprised of a plurality of components. In their broadest context, such components include line blocks and a line. Such components are individually configured and correlated with respect to each other to provide the intended function of aligning a course of masonry.

Specifically, referring to FIGS. 1–5, the present invention includes at least two line blocks 12. Each line block has a general U-shape with squared-off corners. Each line block is formed of a rigid plastic material. Other rigid materials such as wood or metal may also be utilized. Each line block is formed of a short leg 14, a long leg 16, and a cross-leg 18 therebetween. Each line block defines a holding space 20 for receiving a door buck 22. Each leg of a line block has a central axis and a generally rectangular cross-section. The long leg has a length at least 60% greater than that of the short leg. The cross-leg has a length equal to that of the long leg. The cross-leg further includes a longitudinal groove 24 formed along its peripheral extent at a location remote from the holding space. The groove is projected through both the long leg and short leg and is aligned in parallel with the central axis. The short leg includes an axial circular bore 26 formed therethrough. This bore is in communication with the groove. The diameter of the bore is equal to the depth of the groove. The groove and bore of each line block are adapted to hold and retain an end of a line therein.

Also provided is a line 30. The line may be a string or a flexible wire. The line has a knot or other similar enlarged piece formed at each end. The line is disposed within the groove 24 of each line block, and each knot thereof is positioned within a separate bore 26 of each line block. The line is extendable in a taut configuration and thereby defining a plumb line. This plumb line is used for facilitating a level construction of a course of masonry 32 when the line blocks are extended and secured between a pair of spaced door bucks.

The present invention is designed to fit any standard steel door buck to level, plumb, and align a course of masonry. The present invention is a precision rectangular line block made of solid hard plastic. The present invention is U-shaped with one leg shorter than the other. The thickness of the present invention is about ¾ inch. The cross leg is about 2 inches long by about ¾ inches high. The long leg is about 2 inches high by about ⅞ inches wide. The short leg is about 1¼ inches long by about ¾ inches wide. A 3/16 inch diameter bore is positioned through the center of the short leg. A 3/16 inch longitudinal groove is located along the center of the cross leg of the block on its outside perimeter.

The present invention is used on masonry walls of brick, block, or tile. A line is inserted into the groove and bore in a line block, and it is then attached to a door buck at the prescribed height. The line is pulled to the next door buck, inserted into the groove and bore of the other line block, and pulled to the desired tightness to define a plumb line. The line blocks are then slidably adjusted with respect to the door bucks such that the plumb line is level. For each course of masonry, the present invention can be moved up the door bucks without detaching the line or line blocks.

The present invention provides a faster and more efficient method of laying a course of bricks so that they are level, plumb, and aligned. The present invention eliminates the need to build a masonry lead or lay a masonry unit and level for each course of masonry.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A line block masonry alignment system comprising, in combination:

at least two rigid plastic and generally U-shaped line blocks having squared-off corners, each line block formed of a short leg, a long leg, and a cross-leg therebetween and with the line block defining a holding space for receiving a door buck, each leg having a central axis and a generally rectangular cross-section, the long leg having a length of at least 60% greater than that of the short leg, the cross leg having a length equal to that of the long leg, the cross leg further having a longitudinal groove formed along its peripheral central extent at a location remote from the holding space and with the groove projected through both the long leg and short leg, the short leg having an axial circular bore formed therethrough with the bore in communication with the groove and with the diameter of the bore being equal to the depth of the groove, the groove and bore of each line block adapted to hold and retain an end of a line therein; and a line having a knot formed at each end and with the line disposed within the groove of each line block and each knot thereof positionable within the bore of each line block, the line extendable in a taut configuration and thereby defining a plumb line for facilitating the level construction of a course of masonry when the line blocks are secured between a pair of spaced door bucks.

2. A line block masonry alignment system comprising:

at least two rigid and generally U-shaped line blocks, each line block having a short leg, a long leg, and a cross-leg therebetween and with each line block defining a holding space for receipt of a door buck, each leg having a generally rectangular cross-section, the cross leg having a length equal to that of the long leg, the cross leg further having a longitudinal groove formed along its peripheral extent at a location remote from the holding space and with the groove projected through both the long leg and short leg, the short leg having an axial bore formed therethrough with the bore in communication with the groove and with the groove and bore of each line block adapted to hold and retain an end of a line therein for facilitating the level construction of a course of masonry when the line is extended taut.

3. The line block masonry alignment system as set forth in claim 2 further including a line having a knot formed at each end and with the line disposed within the groove of each line block and each knot thereof positionable within the bore of each line block, the line extendable in a taut configuration and thereby defining a plumb line for facilitating the level construction of a course of masonry when the line blocks are secured between a pair of spaced door bucks.

4. The line block masonry alignment system as set forth in claim 2 wherein the long leg has a length at least 60% greater than that of the short leg and wherein the long leg has a length equal to that of the cross leg.

5. The line block masonry alignment system as set forth in claim 2 wherein the bore has circular extent and the diameter of the bore is equal to the depth of the groove.

* * * * *